US005152671A

United States Patent [19]

Harant

[11] Patent Number: 5,152,671

[45] Date of Patent: Oct. 6, 1992

[54] HAEMODIALYSIS PROCESS

[75] Inventor: Anton Harant, Villingen-Schwenningen, Fed. Rep. of Germany

[73] Assignee: INFUS Hospitalbedarf GmbH & Co. Vertriebs KG, Fed. Rep. of Germany

[21] Appl. No.: 731,110

[22] Filed: Jul. 15, 1991

Related U.S. Application Data

[62] Division of Ser. No. 502,978, Mar. 30, 1990.

[30] Foreign Application Priority Data

Mar. 30, 1989 [DE] Fed. Rep. of Germany ..... 3910331

[51] Int. Cl.[5] ..... F04B 15/00

[52] U.S. Cl. ..... 417/53; 210/646; 417/413

[58] Field of Search ..... 210/646; 417/53, 413, 417/418

[56] References Cited

U.S. PATENT DOCUMENTS

| | | | |
|---|---|---|---|
| 3,327,633 | 6/1967 | Duinker et al. | 417/413 |
| 3,433,983 | 3/1969 | Keistman et al. . | |
| 3,625,636 | 12/1971 | Nelson . | |
| 3,939,069 | 2/1976 | Granger et al. . | |
| 3,979,284 | 9/1976 | Granger et al. . | |
| 4,209,391 | 6/1980 | Lipps et al. . | |
| 4,676,905 | 6/1987 | Nagao et al. | 210/646 |

FOREIGN PATENT DOCUMENTS

| | | | |
|---|---|---|---|
| 2031107 | 1/1971 | Fed. Rep. of Germany . | |
| 3016720 | 11/1981 | Fed. Rep. of Germany . | |
| 3328744 | 2/1985 | Fed. Rep. of Germany . | |
| 3719939 | 12/1987 | Fed. Rep. of Germany . | |
| 1548723 | 12/1968 | France . | |
| WO87/07683 | 12/1987 | PCT Int'l Appl. . | |
| 573550 | 3/1976 | Switzerland . | |
| 1252541 | 8/1986 | U.S.S.R. | 417/413 |
| 1307825 | 2/1973 | United Kingdom . | |
| 1344877 | 1/1974 | United Kingdom . | |

*Primary Examiner*—Gerald A. Michalsky
*Attorney, Agent, or Firm*—Marshall, O'Toole, Gerstein, Murray & Bicknell

[57] ABSTRACT

A process for haemodialysis, includes providing a dialyzer utilizing an electromagnetically controllable double membrane pump, whereby the membranes are each supported against an incompressible liquid during the stroke movement of a pump piston. The process includes filling the space between the membranes with the incompressible liquid, stroking the piston thereby sucking deaerated fresh dialysate through an opening in a front cover plate and into a first swept space bounded by one membrane and the front cover plate while simultaneously discharging used dialysate through an opening in a second cover plate and out of a second swept space bounded by the other membrane and the second cover plate. The pump piston then strokes to the other end of its range thereby discharging the fresh dialysate through another opening of the front end cover plate, and sucking used dialysate through another opening of the second cover plate.

5 Claims, 2 Drawing Sheets

HAEMODIALYSIS PROCESS

This is a division of application Ser. No. 07/502,978, filed Mar. 30, 1990.

TECHNICAL FIELD OF THE INVENTION

The invention relates to an electromagnetically controllable membrane pump of and to a way of using the membrane pump.

BACKGROUND OF THE INVENTION AND PRIOR ART

Membrane pumps of this kind are commercially available. They are used to deliver small volumes of a liquid very accurately while maintaining a separation between the liquid delivered and the moving parts of the pump. In membrane pumps an impermeable elastic membrane is held immovably at its edges while its central section is subjected to a stroke movement. For this purpose the central section of the membrane is connected to a core or piston formed as a plunger which is surrounded by an excitation coil. On excitation (or energisation) the piston is attracted into the excitation coil against the return force of the membrane or another means of producing spring tension. On de-energisation the spring-loading returns it to its starting position. During the stroke movement when the excitation coil is excited the medium to be delivered is sucked through an inlet opening into the swept space formed on the side of the membrane remote from the piston between the membrane and a cover plate securing it. Suitably there is a valve in the suction opening in the cover plate which opens only in the direction of suction. Most simply this is a spring-loaded flap. During the other stroke movement the volume sucked in is discharged again through another opening which includes a valve opening only in the direction of discharge, which in the simplest case is again a spring-loaded flap. This ensures that sucking-in can only occur during the one displacing movement and discharge only during the other displacing movement.

A disadvantage of commercially available metering pumps of this kind, however, is that the membranes used have to be relatively stiff so that they do not bend during the discharge stroke during which they have to deliver against pressure. As a result of this the force needed to displace the membranes must be large in order to overcome the high return force or spring-loading provided by such membranes. A further disadvantage is that the membranes age and become softer with time. Because of this the volume delivered per stroke changes, which is very undesirable. This is particularly undesirable if high-precision delivery is involved, for example of very small quantities in the medical field. A particular example is the delivery of dialysate to a dialyser in haemodialysis. In such an application it is essential to ensure that too much dialysate is not supplied to the dialyser under any circumstances as otherwise dialysate could get into the circulatory system of a patient, which is extremely dangerous. On the other hand the amount of dialysate supplied must not be too small, as the blood purification can then not be carried out completely. Finally, it is necessary, particularly in this type of application, to ensure that the dialyser is always and continuously supplied with an amount of fresh dialysate equal to the amount of used dialysate which is removed. For this purpose so-called balancing systems are used which are supplied continuously with fresh dialysate by means of ordinary feed pumps and the continuous flow is regulated by means of controlled valves and a bypass line.

OBJECT OF THE INVENTION

It is therefore an object of the invention to provide an improved membrane pump of the kind mentioned in the introduction with which, despite having a simple construction, the same amount can be delivered per stroke for prolonged periods of time, and a way of using such a membrane pump which makes simpler and extremely accurate balancing possible.

SUMMARY OF THE INVENTION

This object is achieved by the features of the pump characterized in the claims.

Further aspects of the invention are to be found in the features of the subclaims.

The membrane pump according to the invention is particularly useful in haemodialysis.

The invention is based on the discovery that a very soft membrane can be used if it remains supported against an incompressible liquid during the whole of the stroke movement. This is achieved if the piston is moved in a constant volume of this incompressible liquid, taking the membrane with it. Because it is formed as a double membrane pump, whereby a suction stroke at one membrane and a discharge stroke at the other membrane are performed in parallel, it is possible to keep the amounts delivered extremely constant.

Its use for haemodialysis gives a very simple system in which no valves have to be controlled but in which a continuous feed can be actively ensured. Furthermore the amounts delivered can be adjusted by changing the stroke speed, which in turn can be controlled very accurately by altering the excitation current or the cycle frequency. In this way an accurate balancing system can be obtained that is both simple and very easy to maintain.

BRIEF DESCRIPTION OF THE DRAWINGS

The invention will be described in more detail with reference to exemplary embodiments shown in the drawings, in which.

DETAILED DESCRIPTION OF PREFERRED EMBODIMENTS OF THE INVENTION

Figure 1:
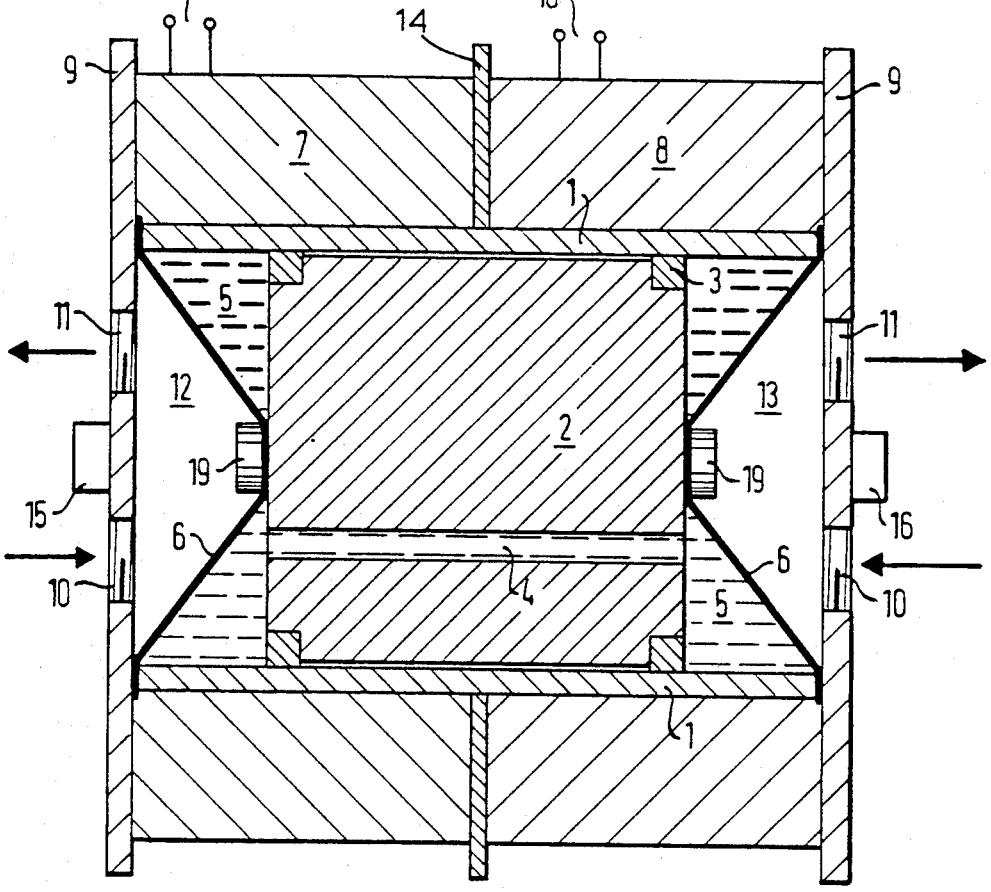
FIG. 1 shows diagrammatically, in section, a double membrane pump according to the invention.

As shown in FIG. 1 the membrane pump has a hollow cylinder 1 in the interior of which a cylindrical piston 2 is arranged to be axially displaceable. The piston 2 is guided in the interior of the hollow cylinder 1 by sliding rings 3 which are in contact with the inner wall of the hollow cylinder 1. The sliding rings 3 also maintain an air gap between the piston 2 and the inner wall of the hollow cylinder 1. This air gap is necessary if the hollow cylinder 1 consists of a magnetisable material such as soft iron. If the hollow cylinder 1 consists of a dielectric such as a plastics material guidance of the piston 2 can be ensured in other ways. At each end face of the hollow cylinder 1 a respective membrane 6 is clamped firmly at its edges between the hollow cylinder 1 and a respective cover plate 9. Each membrane 6 is connected securely and tightly at its centre to the piston 2. The piston 2 itself has at least one through-bore 4 in the axial direction so that the chambers 5 between the end faces of the piston 2 and the respective associated membrane 6 are connected to one another by way of the through-bore 4. The through-bore 4 and the chambers 5 are filled with an incompressible fluid. Mounted externally on the hollow cylinder 1 are two excitation coils 7 and 8, each of which is associated with one of the membranes 6. Connection leads 17 and 18 lead outwardly and are connected to an electric control device (not shown). The two excitation coils 7 and 8 are separated from one another by separating elements 14 arranged axially in the centre.

Between one membrane, in FIG. 1 the membrane 6 on the left-hand side, and the associated cover plate 9 a first swept space 12 is formed, while between the other membrane, in FIG. 1 the membrane 6 on the right-hand side, and the associated cover plate 9 a second swept space 13 is formed. In each of the cover plates 9 there is at least one feed opening 10 and one discharge opening 11. An inlet valve is associated with each feed opening 10 which opens only in the inlet direction and is closed in the opposite direction. A valve is likewise associated with each outlet opening 11 which, however, opens only in the outlet direction but is always closed in the other direction. In the simplest case these are spring-loaded flap valves of the kind commonly used in hydraulic and pneumatic systems.

Figure 2:
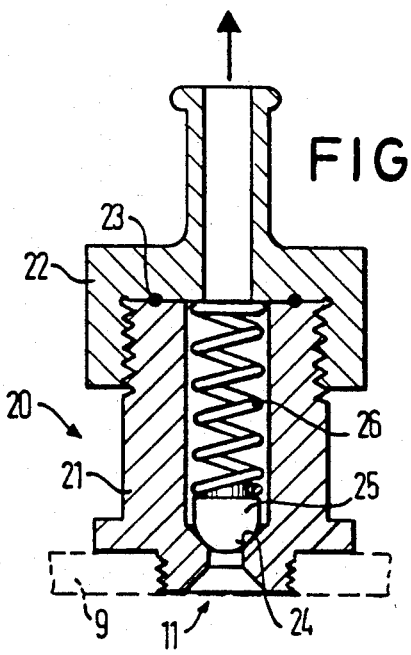
FIG. 2 and FIG. 3 show types of outlet and inlet valves for the membrane pump shown in FIG. 1.
Figure 3:
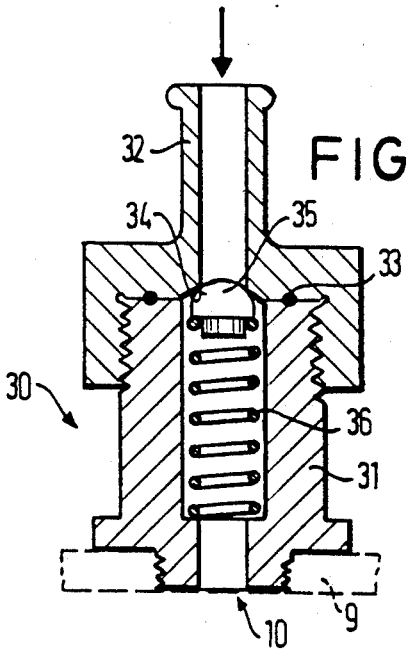

Other types of valve are shown in FIG. 2 and FIG. 3.

FIG. 2 shows an outlet valve 20 which can be screwed into the outlet opening 11 in the cover 9 or can be attached in some other way. The outlet valve 20 comprises a sleeve part 21, that can be secured in this opening 11, and on to which a connecting piece 22 can be screwed with a seal 23 interposed and whose connection end is formed so that lines, for example hose lines, can be clamped or otherwise attached thereto. In the sleeve part 21, which is essentially a hollow cylinder, a valve seat 24 is formed near the end pointing towards the outlet opening 11. On the side of the valve seat remote from this outlet opening 11 is a valve body 25 which is urged against the valve seat 24 by a spring 26, the spring 26 being supported at its other end on the screwed-on connecting piece 22 that is likewise essentially a hollow cylinder. Pressure in the direction of the arrow lifts the valve body 25 from the valve seat 24 against the force of the spring 26 and allows a medium to flow by until the feed pressure stops.

FIG. 3 shows an inlet valve 30 that is constructed in a similar way and has a screw-in part 31 and a connecting part 32 which are likewise formed as hollow cylinders and can be connected tightly together by way of a seal 33. A valve seat 34 is formed in the connecting part 32 on the end facing the screw-in part 31, and a valve body 35 is urged against the seat by means of a spring 36 supported in the screw-in part 31. If pressure is exerted by way of a feed line connected to the connecting part 32 the valve body 35 is lifted, from the valve seat 34 against the force of the spring 36 and allows a medium to flow by and flow through the inlet opening 10 of the cover plate 9. When the pressure ceases the valve 30 is closed immediately and prevents return flow.

The valves 20 and 30 shown in FIG. 2 and FIG. 3 can, as already mentioned, be screwed into the openings 10 and 11 in the cover plate 9 so that the contours of the swept spaces 12 and 13 are not affected.

FIG. 1 shows the piston 2 of the membrane pump in a rest position determined by the intrinsic elasticity of the membranes 6, i.e. a position in which neither of the excitation coils 7 and 8 is excited.

If one of the excitation coils is excited (or energised), for example the excitation coil 7, the piston 2 is attracted because of the resulting electromagnetic field and moves to the left in FIG. 1, as a result of which the swept space 12 becomes smaller until the membrane 6 abuts against the cover plate 9 and the medium to be delivered contained therein is discharged through the outlet opening 11 by opening the valve 20 while the other swept space 13 becomes larger and medium to be delivered is sucked in by way of the inlet opening 10 and the opened inlet valve 30. While this occurs the inlet valve 30 in the inlet opening 10 of the swept space 12 on the one side and the outlet valve 20 in the outlet opening 11 in the other swept space 13 on the other side necessarily remain closed, i.e. a suction stroke occurs in the swept space 12 while a discharge stroke occurs in the swept space 13. If the excitation state is changed, i.e. the excitation coil 8 is excited and the excitation coil 7 is de-energized, a stroke movement occurs in the other direction so that a suction stroke takes place in the swept space 12 and a discharge stroke in the swept space 13.

During the movement of the piston 2 from right to left or left to right the incompressible liquid is moved from one chamber 5 through the through-bore 4 to the other chamber 5 so that this incompressible liquid always exerts the same supporting force on both membranes 6 and the membranes 6 can thus not bend. This ensures that the amount of medium to be conveyed that is delivered or sucked in is always the same with each stroke movement, namely for each of the two swept spaces 12 and 13. In the embodiment of the membrane pump shown, the swept spaces 12 and 13 and the two stroke volumes are likewise identical.

With a double membrane pump of the kind shown in FIG. 1 simple continuous feeding can be achieved, as will be explained with reference to FIG. 5. In this double membrane pump P, in which the one excitation state and the corresponding stroke state is indicated diagrammatically by a thick black line and corresponds to excitation of the excitation coil 7 and de-excitation of the excitation coil 8, and a corresponding movement of the piston 2 to the left corresponds to the representation shown in FIG. 1, all the inlet openings 10 are connected by way of associated valves 30 to a container R via ordinary lines and without a valve at the branching point 28. On the other side the outlet openings 11 with their associated outlet valves 20 lead directly via a junction 29 without additional valves and a discharge line to a consuming unit U. In the position of the double membrane pump P shown in FIG. 5 suction occurs by way of the lines indicated by thick lines from the container R via the inlet opening 10 on the right-hand side and the inlet valve 30 on the right-hand side, and on the other side discharge takes place by way of the outlet valve 20 on the left-hand side and the outlet opening 11 on the left-hand side with the pump P via the junction 29 to the consuming unit U. The inlet valve 30 on the left-hand side and the outlet valve 20 on the right-hand side are necessarily closed so that no delivery occurs here. When the piston moves in the other direction, i.e. in the other excitation state (excitation coil 8 excited, excitation coil 7 de-energized), delivery occurs in the other direction, so that with each movement of the piston, i.e. with each change in the excitation state, medium is fed from the container R to the consuming unit U.

The two swept spaces 12 and 13 of the pump P (cf. FIG. 1) can, however, also be supplied from different containers so as to supply different media to the same consuming unit in a predetermined volume ratio. On the other hand two consuming units can also be supplied alternately from a common source.

Figure 5:
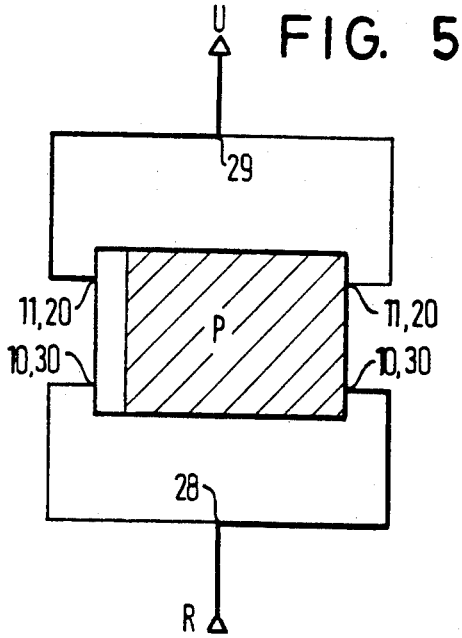
FIG. 5 shows diagrammatically the use of the membrane pump for continuous delivery of a medium.

The double membrane pump shown in FIG. 1 used as shown in FIG. 5 allows a flow rate to be achieved that is twice as high as with a membrane pump having only one membrane.

The excitation coils 7 and 8 can be excited with alternating current, in which case at least part of the piston 2, for example an annular sleeve part, may consist of a permanently magnetic material. If excitation occurs with direct current the piston 2 may consist in the same way at least in part of a soft magnetic material, for instance soft iron or the like. It is apparent that the hollow cylinder 1 can also consist of soft iron and then acts as yoke and must then have an air gap between it and the piston 2 unless the exterior of the piston 2 consists of a dielectric. If, on the other hand, the hollow cylinder 11 consists of a dielectric material the piston 2 can be guided without an air gap. The incompressible liquid must on no account have any magnetic properties.

The double membrane pump according to the invention is particularly suitable for balancing systems. This will be explained in more detail with reference to a special application, namely haemodialysis, with reference to the diagrammatic representation shown in FIG. 4.

Figure 4:
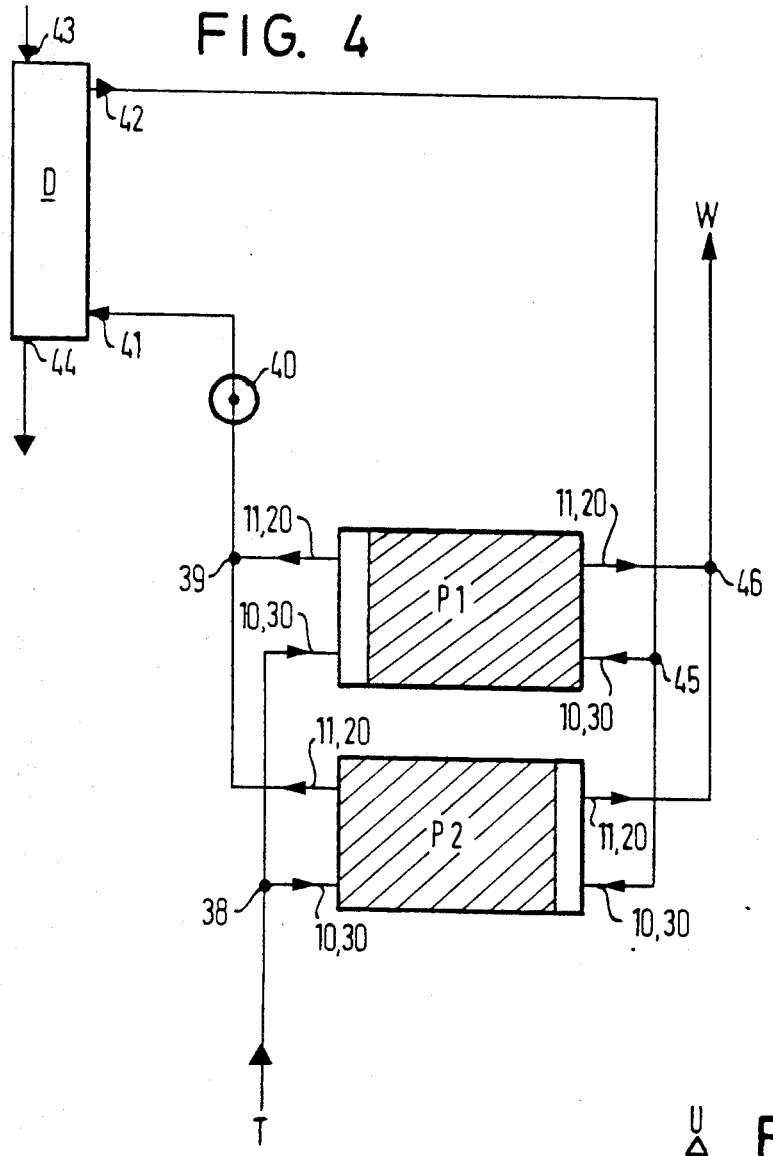
FIG. 4 shows diagrammatically the use of the membrane pump in haemodialysis.

FIG. 4 shows two double membrane pumps P1 and P2 designed according to the invention under push-pull control. The left-hand inlet openings 10 of both pumps P1 and P2 are connected at a branching point 38 to a container T for fresh dialysate by way of appropriate inlet valves 30, but with no additional valves. The left-hand outlet openings 11 are connected to the dialysate inlet 41 of a dialyser D by way of corresponding outlet valves 20 and via a junction 30 without additional valves, and through a flow regulator 40. Blood to be purified from a patient (not shown) is supplied to the dialyser D by way of an inlet 43. Purification of contaminated blood is effected by means of dialysate in the usual way using the osmotic technique. The purified blood leaves the dialyser D by way of an outlet 44, the contaminated dialysate leaves the dialyser by way of an outlet 42. The contaminated dialysate is supplied to the right-hand inlet openings 10 of the two pumps P1 and P2 over a branching point 45 without additional valves and by way of appropriate inlet valves 30. The right-hand outlet openings of both pumps P1 and P2 are connected to a drain W without additional valves by way of associated outlet valves 20 and a junction 46.

The push-pull control of the two pumps P1 and P2, i.e. control such that when the piston 2 of the one pump moves from right to left the piston 2 of the other pump moves inversely thereto from left to right, ensures that on the one hand one of the two pumps is always sucking from the dialysis container T while the other pump simultaneously delivers the previously sucked-in fresh dialysate to the dialyser D, and that on the other hand the latter pump simultaneously sucks in used dialysate from the dialyser D, while the first pump simultaneously expels the previously sucked-in used dialysate to the drain W. In this way fresh dialysate is always available for delivery to the dialyser D, and is fed to the dialyser D in a volume per unit time that depends upon the stroke speed of the piston but is constant. Because the pumps P1 and P2 are double membrane pumps exactly the same amount, namely also the same volume per unit of time, is however simultaneously discharged from the outlet 42 and sucked in by the pump which is delivering fresh dialysate to the dialyser D. In this way a so-called zero-balance is achieved, i.e. no weight (so-called ultrafiltrate) is taken from the patient. Furthermore, by using two double membrane pumps P1 and P2 completely continuous operation is achieved.

It is also desirable with membrane pumps of this kind to be able to adjust the volume delivered per unit of time. This can be achieved by changing the stroke speed, in particular by changing the amplitude of the excitation current. At a higher excitation current the piston 2 is moved more quickly, i.e. the stroke movement is carried out more quickly. Alternate excitations can thus follow in quicker succession. The setting of the cycle alternation can be done from outside, for example by triggering the excitation current source by rectangular pulses of different lengths. However, control is also possible in which excitation alternation occurs immediately the piston 2 has reached one of its respective end positions. For this purpose end position sensors 15 and 16 can (cf. FIG. 1) be provided on the two cover plates 9 which trigger excitation alternation by giving a signal when the respective membrane 6 meets the respective cover plate 9. The schematic and exaggerated shown fixing element 19 for fixing the membrane 6 centrally to the piston 2 can, for example, bridge contacts when it comes up against the respective end position indicator 15, 16. A contact-less operating proximity switch or another limit switch of known design can also be used.

It should be noted that the incompressible liquid supports the membrane 6, which is why a comparatively soft membrane can be used, which in turn allows a larger stroke. Since the piston 2 moves on, forcing this incompressible liquid through the through-bore 4 to the respective other side of the piston 2, it is advantageous if the incompressible liquid has lubricating properties and can thus assist the stroke movement of the piston 2. In particular for applications in which the incompressible liquid could trigger undesirable reactions on meeting the medium being delivered, for example poisoning of the dialysate in the application described, an incompressible liquid must further be chosen which is compatible with the medium conveyed. Since the entry of incompressible liquid into the medium conveyed is a sign of leakage, in particular a tear or porosity in the membrane 6, it is of further advantage to choose the incompressible liquid so that in such a case a reaction is triggered which is immediately recognisable from outside, for example a clearly recognisable colour change or the like. Since in such cases the pressure conditions also suddenly change alarm indicators reacting thereto can be used to indicate such a case.

If when using a double membrane pump designed according to the invention different volumes per unit time have to be delivered from the two swept spaces 12 and 13, the membranes 6 can each have a different elasticity and/or the excitation coils 7 and 8 can be excited with different currents. This results in different stroke speeds. It is constructionally more complicated but likewise possible to make the sizes of the two swept spaces 12 and 13 different, but here it is important that the stroke is kept the same by constructional measures.

If high delivery rates are necessary a plurality of inlet openings 10 and outlet openings 11 can be provided in each stroke chamber 12 and 13 which are fed and emptied in parallel.

Altogether, the invention provides a membrane pump that is of simple construction and can therefore be easily and simply maintained, and in which individual parts can be exchanged in a simple manner. Furthermore the membrane pump can also be used if sterilization of a medium is necessary at least with regard to the flow path. The membrane pump is therefore also suitable for medical purposes.

What is claimed is:

1. A haemodialysis process comprising the steps of (1) providing a dialyzer utilizing an electromagnetically controllable membrane pump having a hollow cylinder, a front end cover plate of the hollow cylinder having first and second openings that can each be closed by a respective valve, a piston that can be influenced magnetically and which is guided to be axially displaceable in the hollow cylinder with a peripheral excitation coil on a longitudinal section of the hollow cylinder, a magnetically effective gap defined between the piston and the excitation coil, an elastic membrane which is clamped at its edges between the cover plate and the hollow cylinder and is connected centrally with the piston, a second cover plate having first and second openings and mounted on the hollow cylinder at its other end, each of said openings adapted to be closed by respective first and second valves, a second elastic membrane clamped at its edges between the second cover plate and the hollow cylinder and connected approximately centrally to the piston, said piston having at least one axial through-bore, (2) filling the space between the membranes, including the through-bore with an incompressible liquid, (3) energizing the excitation coil thereby moving the piston to an end position, sucking deaerated fresh dialysate into the first opening of the front end cover plate and discharging used dialysate through the second opening of the second cover plate, and (4) de-energizing the excitation coil thereby moving the piston to an opposite end position, discharging the fresh dialysate through the second opening of the front end cover plate and sucking used dialysate through the first opening of the second cover plate.

2. A haemodialysis process according to claim 1 including the step of supplying deaerated fresh dialysate to the dialyzer in amounts equal to the amounts of used dialysate discharged therefrom.

3. A haemodialysis process according to claim 1, wherein the incompressible liquid in the pump is free from toxic and other properties harmful to the cleaned blood.

4. A haemodialysis process according to claim 1, wherein the incompressible liquid in the pump is such that it changes the colour of the fresh dialysate.

5. A haemodialysis process according to claim 1, wherein in said pump said first and second valves in said cover plate can be screwed in from outside and are formed at their other end as tubes for the connection of hoses.

* * * * *